US005080529A

United States Patent [19]

Watanabe et al.

[11] Patent Number: 5,080,529

[45] Date of Patent: Jan. 14, 1992

[54] BELT-LIKE BAG BODIES

[75] Inventors: Kimiyoshi Watanabe; Seigi Yamase, both of Yokohama, Japan

[73] Assignee: Bridgestone Corporation, Tokyo, Japan

[21] Appl. No.: 552,029

[22] Filed: Jul. 13, 1990

[30] Foreign Application Priority Data

Jul. 18, 1989 [JP] Japan ..... 1-186273

[51] Int. Cl.[5] ..... E02B 7/20

[52] U.S. Cl. ..... 405/63; 405/115; 277/34; 138/119

[58] Field of Search ..... 405/115, 63; 277/34, 277/34.3, 34.6; 138/93, 119; 49/477

[56] References Cited

U.S. PATENT DOCUMENTS 4,299,514 11/1981 Muramatsu et al. ..... 405/115
4,342,336 8/1982 Satterthwaite et al. .
4,662,783 5/1987 Muramatsu et al. ..... 405/115

FOREIGN PATENT DOCUMENTS 877257 5/1953 Fed. Rep. of Germany ..... 277/34.3
2230132 1/1974 Fed. Rep. of Germany ..... 49/477
181911 10/1983 Japan ..... 405/115
37317 2/1985 Japan ..... 405/115
2030624 4/1980 United Kingdom ..... 405/115

*Primary Examiner*—Dennis L. Taylor
*Assistant Examiner*—John Ricci
*Attorney, Agent, or Firm*—Sughrue, Mion, Zinn, Macpeak & Seas

[57] ABSTRACT

A belt-like bag body comprises a belt-like rubber sheet, a non-adhesion region located at a central portion the rubber sheet and capable of separating the rubber sheet into upper and lower portions, and a reinforcing layer reinforcing the outer surface of the rubber sheet, wherein a notch or gap having a convexly arc portion outward in widthwise direction is arranged in the vicinity of a widthwise end of the non-adhesion region in the rubber sheet.

5 Claims, 4 Drawing Sheets

BELT-LIKE BAG BODIES

BACKGROUND OF THE INVENTION

1. Field of the Invention

This invention relates to belt-like bag bodies, and more particularly to an improvement of a belt-like bag body for use in a silt fence, an oil fence, a rubber dam, a hydraulic jack, a sink-float type fishpond and the like.

2. Related Art Statement

As this type of the bag body, there is a belt-like bag body as shown in FIGS. 7 and 8. This bag body 1 comprises a belt-like rubber sheet 2 and a non-adhesion region 3 located in a central portion in the thickness direction of the rubber sheet 2 so as to extend toward the widthwise direction thereof and capable of separating the rubber sheet 2 to upper sheet portion 2*a* and lower sheet portion 2*b* for forming a gas or liquid passage. Furthermore, the belt-like bag body 1 is provided with a layer-like reinforcing canvas 5 located outside the rubber sheet 2 and surrounding this rubber sheet 2. Moreover, the bag body 1 comprises an outer coating rubber 7 covering the outer surface of the reinforcing canvas 5, if necessary. This coating rubber 7 is provided with two reinforcing canvases 6 located in the upper and lower portions of the bag body 1 in parallel to each other for reinforcing the reinforcing canvas 5.

In use of this belt-like bag body 1, water, air or other fluid is supplied to the non-adhesion region 3 in the rubber sheet 2 to largely separate the central portion of the rubber sheet 2 and expand it into a substantially circular form as shown in FIG. 8. A fluid passage 8 is thus formed for use in the silt fence, oil fence or the like.

In the conventional belt-like bag body, however, a large stress concentration occurs in the rubber sheet 2 at a widthwise end 3*a* of the non-adhesion region 3 between the reinforcing canvas 5 and the passage 8 during the expansion of the rubber sheet 2, and consequently cracks 9 are created in the rubber sheet 2. When the bag body 1 is used over a long time, the crack 9 grows to arrive at the reinforcing canvas 5. In the latter case, the fluid in the passage 8 arrives at the reinforcing canvas 5 through the crack 9. Furthermore, the fluid leaks up to the outer reinforcing canvas 6 along the fibers constituting the canvas 5 to finally cause swelling trouble, puncture and the like.

SUMMARY OF THE INVENTION

It is, therefore, an object of the invention to provide a belt-like bag body in which a notch or gap having a convexly arc portion outward in the widthwise direction is arranged in the vicinity of the widthwise end of the non-adhesion region in the rubber sheet to prevent the stress concentration in the vicinity of this widthwise end, whereby the occurrence of cracks and hence the leakage of fluid from the passage is prevented to improve the durability of the bag body.

According to the invention, there is the provision of a belt-like bag body comprising a belt-like rubber sheet, a non-adhesion region located at a central portion in thickness direction of the rubber sheet to extend toward the widthwise direction and capable of separating the rubber sheet into upper and lower portions, and a reinforcing layer reinforcing the outer surface of the rubber sheet, characterized in that a notch or gap having a convexly arc portion outward in widthwise direction is arranged in the vicinity of a widthwise end of the non-adhesion region in the rubber sheet.

In a preferred embodiment of the invention, the notch or gap may be contacted with the widthwise end of the non-adhesion region or separated therefrom.

BRIEF DESCRIPTION OF THE DRAWING

The invention will be described with reference to the accompanying drawing, wherein.

DESCRIPTION OF THE PREFERRED EMBODIMENTS

In the belt-like bag body according to the invention, the notch or gap is arranged in the vicinity of the widthwise end of the non-adhesion region in the rubber sheet, so that when the fluid is supplied to the non adhesion region in the rubber sheet, the upper and lower portions of the rubber sheet are separated to expand the non-adhesion region into a space having a substantially circular shape in section for forming a passage. By such expansion, the notch or gap located in the vicinity of the widthwise end of the non-adhesion region is pulled toward the upper and lower portions of the rubber sheet. Since the notch or gap has a convexly arc portion outward in the widthwise direction, it is pulled together with the upper and lower portions of the rubber sheet to form an arc in the vicinity of the widthwise end of the non-adhesion region. Consequently, the widthwise end of the non-adhesion region is not forcedly pulled in up and down directions, so that the stress concentration in the widthwise end is largely suppressed between the passage and the reinforcing layer as compared with the conventional bag body.

Figure 1:
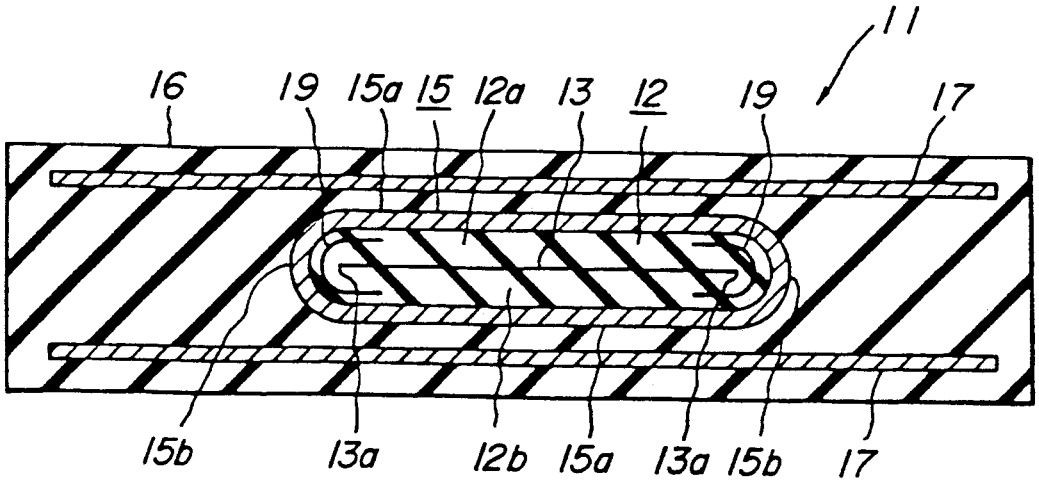
FIG. 1 is a laterally sectional view of a first embodiment of the belt-like bag body according to the invention.
Figure 2:
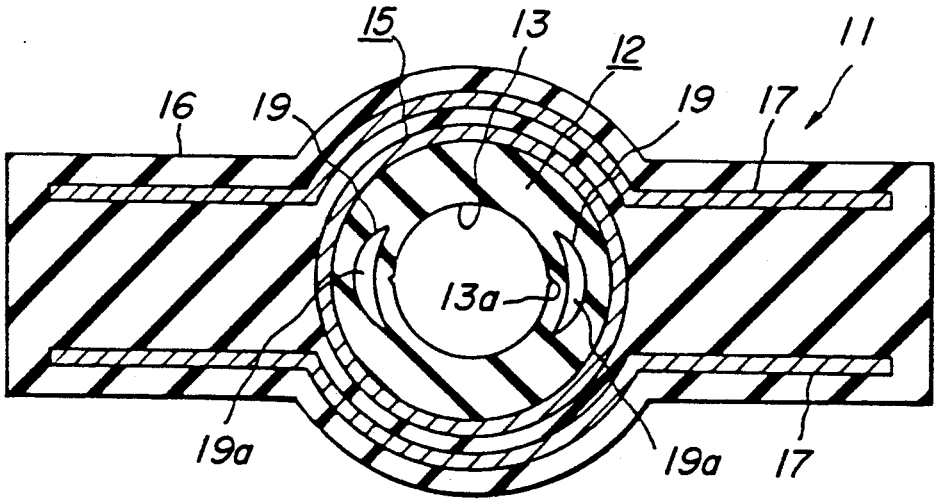
FIG. 2 is a sectional view illustrating an inflation state of the first embodiment.

Referring to FIGS. 1 and 2, a first embodiment of the belt-like bag body according to the invention is shown in a lateral section thereof.

In FIG. 1, numeral 11 is a belt-like bag body, which is an elongated body capable of forming a passage for the passage of a fluid in the central portion in thickness direction and widthwise direction of the bag body 11 in use. This belt-like bag body 11 comprises a belt-like rubber sheet 12, and a non-adhesion region 13 located at the central portion in the thickness direction and widthwise direction of the rubber sheet 12 for forming a passage and capable of separating the rubber sheet 12 into upper portion 12*a* and lower portion 12*b* and having a straight shape in the widthwise direction in section. A reinforcing layer 15 composed of a canvas is arranged outside the rubber sheet 12 so as to surround the rubber sheet 12. This reinforcing layer 15 comprises a flat portion 15a at each of the upper and lower sides of the non-adhesion region 13 and a curved portion 15b having a convexly arc portion outward in the widthwise direction for connecting the upper and lower flat portions 15a to each other at each widthwise ends thereof. An outer coating rubber 16 covering the reinforcing layer 15 is arranged outside the reinforcing layer 15 and provided at its upper and lower portions with two reinforcing layers 17 of canvas located in parallel to each other for reinforcing the above reinforcing layer 15.

Numeral 19 is a notch. This notch 19 is arranged in the vicinity of the widthwise end 13a of the non-adhesion region 13 in the rubber sheet 12 or between the widthwise end 13a and the curved portion 15b of the reinforcing layer 15 so as to have a convexly arc portion 19a outward in the widthwise direction along the reinforcing layer 15.

The function of the first embodiment of the belt-like bag body will be described below.

When a fluid is supplied to the non-adhesion region 13 in the rubber sheet 12, the non-adhesion region 13 is expanded into a substantially circular shape to separate the rubber sheet 12 into upper and lower portions as shown in FIG. 2. Furthermore, a portion of the rubber sheet 12 located between the widthwise end 13a and the reinforcing layer 15 is pulled in up and down directions accompanied with the expansion of the rubber sheet 12 to render the notch 19, which is arranged in the vicinity of the widthwise end 13a of the non-adhesion region 13 in the rubber sheet 12, into a crescent space having a convexly arc portion 19a outward in the widthwise direction. As a result, the stress concentration apt to be created in the vicinity of the widthwise end 13a of the non-adhesion region 13 merely pulls the arc portion 19a of the notch 19 in up and down directions and is considerably suppressed to prevent the occurrence of cracks. Therefore, the leakage of fluid is effectively prevented and also the swelling or puncture trouble is completely suppressed to largely improve the durability of the belt-like bag body 11.

A second embodiment of the belt-like bag body according to the invention will be described below.

Figure 3:
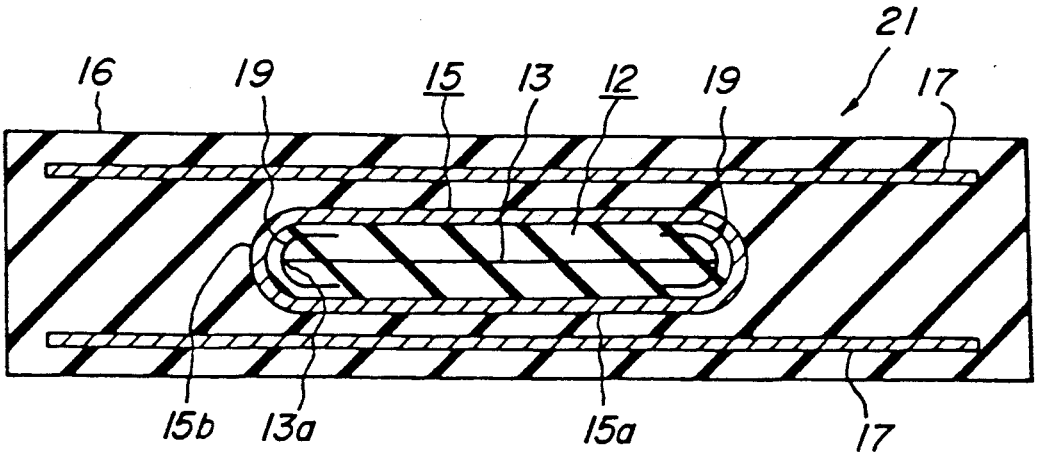
FIG. 3 is a laterally sectional view of a second embodiment of the belt-like bag body according to the invention.
Figure 4:
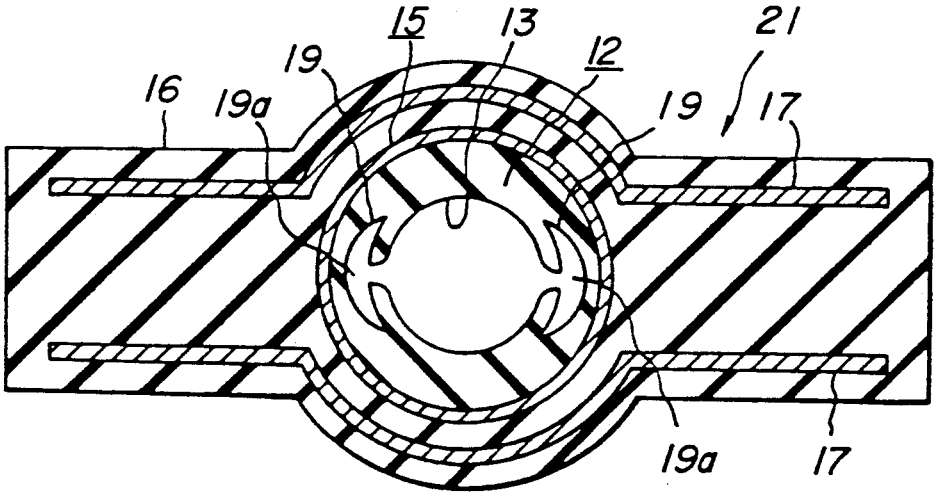
FIG. 4 is a sectional view illustrating an inflation state of the second embodiment.

FIGS. 3 and 4 show the second embodiment of the invention, in which numeral 21 is a belt-like bag body. Moreover, the same parts as in the first embodiment are indicated by the same numeral.

In the second embodiment, the notch 19 is arranged in the vicinity of widthwise end 13a of the non-adhesion region 13 in the rubber sheet 12 so as to come into contract with the widthwise end 13a. When the fluid passes through the non-adhesion region 13, as shown in FIG. 4, the widthwise end 13a of the non-adhesion region 13 and the notch 19 are expanded to form spaces communicating with each other, and also the notch 19 forms a convexly arc portion 19a outward in the widthwise direction.

A third embodiment of the belt-like bag body according to the invention will be described below.

Figure 5:
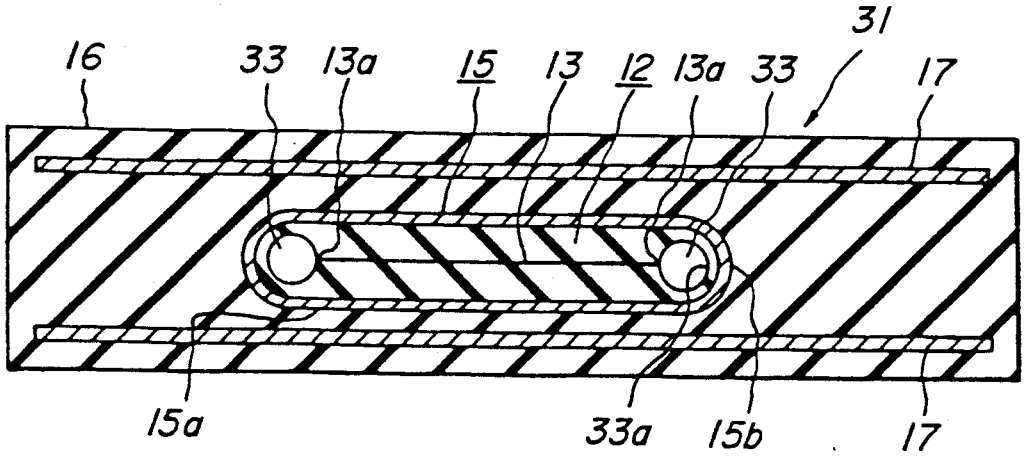
FIG. 5 is a laterally sectional view of a third embodiment of the belt-like bag body according to the invention.
Figure 6:
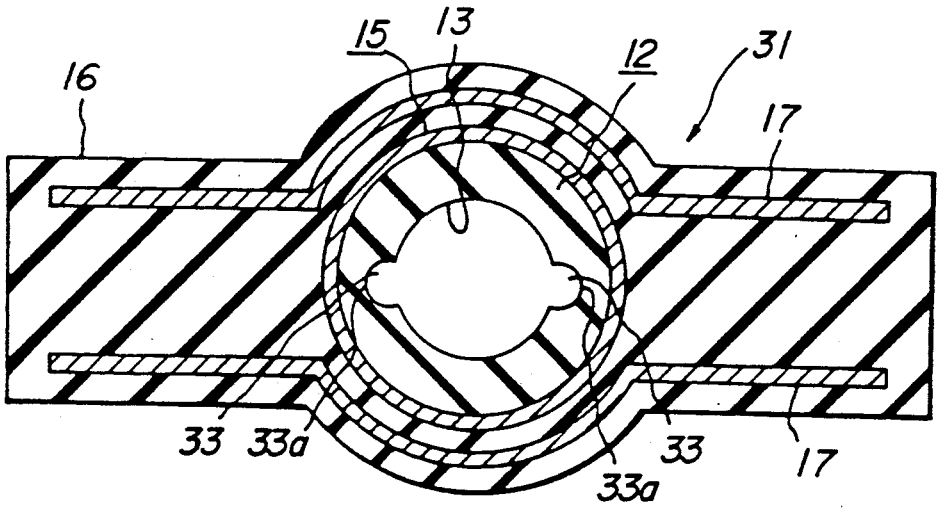
FIG. 6 is a sectional view illustrating an inflation state of the third embodiment.
Figure 7:
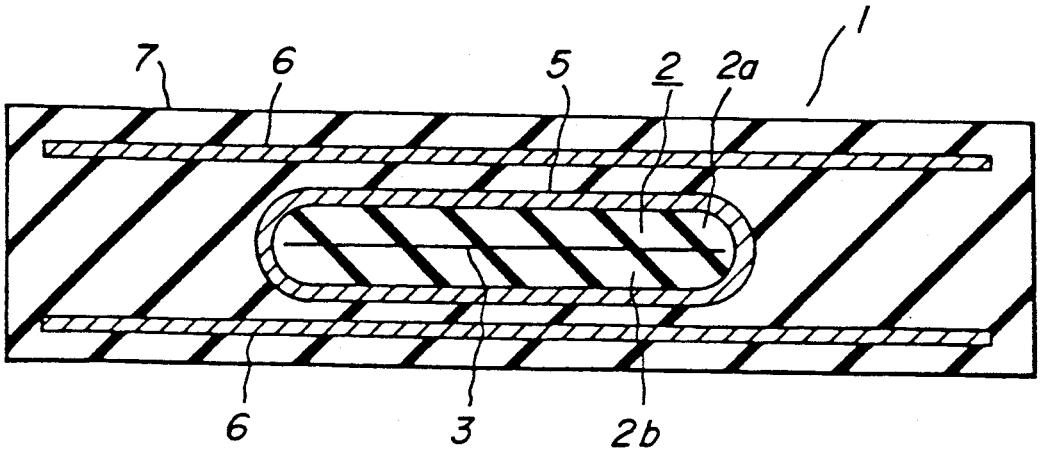
FIG 7 PRIOR ART
FIG. 7 is a laterally sectional view of the conventional belt-like bag body.
Figure 8:
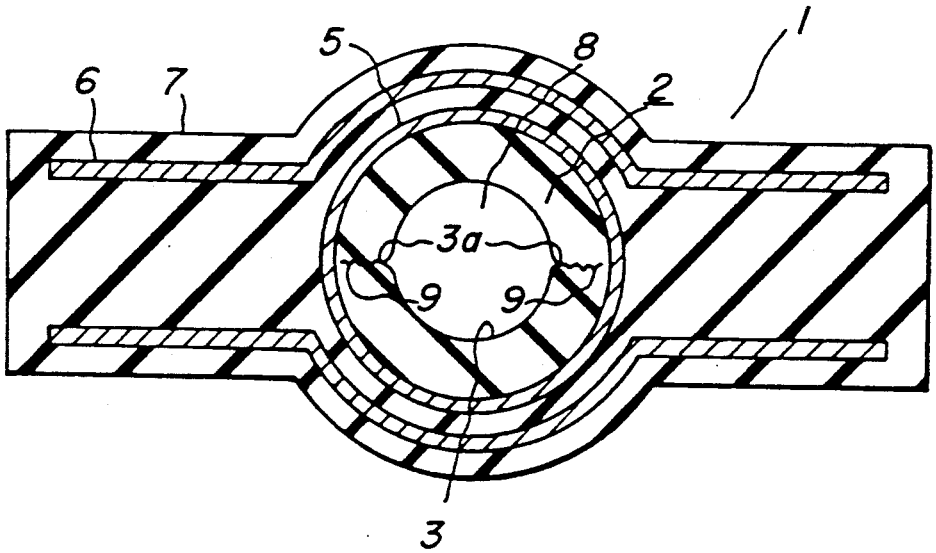
FIG 8 PRIOR ART
FIG. 8 is a sectional view illustrating an inflation state of FIG. 7.

FIGS. 5 and 6 show the third embodiment of the invention, in which numeral 31 is a belt-like bag body. Moreover, the same parts as in the first embodiment are indicated by the same numeral.

In the third embodiment, a gap 33 is arranged in contact with the widthwise end 13a of the non-adhesion region 13 in the rubber sheet 12 instead of the notch 19 in the first embodiment. When the fluid is passed through the non-adhesion region 13, as shown in FIG. 6, the widthwise end 13a of the non-adhesion region 13 and the gap 33 are expanded to form spaces communicating with each other, and also the gap 33 forms a convexly arc portion 33a outward in the widthwise direction.

As mentioned above, according to the invention, the notch or gap having a convexly arc portion outward in the widthwise direction is arranged in the vicinity of the widthwise end of the non-adhesion region in the rubber sheet of the belt-like bag body, so that the stress concentration in the vicinity of the widthwise end can be suppressed to prevent the occurrence of cracks, the leakage of fluid from the passage and occurrence of swelling or puncture trouble, whereby the durability of the belt-like bag body can considerably be improved.

What is claimed is:

1. A belt-like bag body comprising; a belt-like rubber sheet, a non-adhesion region located at a central portion in thickness direction of the rubber sheet extending toward the widthwise direction and capable upon inflation of expanding and separating the rubber sheet into upper and lower portions, a reinforcing layer reinforcing the outer surface of the rubber sheet, and a notch having a convex arc portion extending outward in a widthwise direction arranged to contact each widthwise end of the non-adhesion region in the rubber sheet and a pair of substantially straight portions attached to said arc portion and extending above and below end portions of said non-adhesion region.

2. The belt-like bag body according to claim 1, wherein said notch contacts with each widthwise end of the non-adhesion region.

3. The belt-like bag body according to claim 1, wherein said notch is separated by a portion of said rubber sheet from said non-adhesion region.

4. The belt-like bag body according to claim 1 further comprising an outer coating rubber covering said reinforcing layer and an outer reinforcing layer positioned in said outer coating rubber to reinforce said reinforcing layer.

5. The belt-like bag body according to claim 1, wherein said reinforcing layer surrounds said non-adhesion region.

* * * * *